US009381570B2

(12) United States Patent
Poggi

(10) Patent No.: US 9,381,570 B2
(45) Date of Patent: Jul. 5, 2016

(54) PREFORM FOR MANUFACTURING A METAL FOAM

(75) Inventor: Frederic Poggi, Pierrefeu du var (FR)

(73) Assignee: FILTRAUTO, Guyancourt (FR)

( * ) Notice: Subject to any disclaimer, the term of this patent is extended or adjusted under 35 U.S.C. 154(b) by 274 days.

(21) Appl. No.: 13/994,401

(22) PCT Filed: Dec. 28, 2011

(86) PCT No.: PCT/FR2011/000680

§ 371 (c)(1),
(2), (4) Date: Dec. 16, 2013

(87) PCT Pub. No.: WO2012/089935

PCT Pub. Date: Jul. 5, 2012

(65) Prior Publication Data

US 2014/0106180 A1 Apr. 17, 2014

(30) Foreign Application Priority Data

Dec. 29, 2010 (FR) ..... 10 05153

(51) Int. Cl.
*B22D 25/00* (2006.01)
*B22D 25/02* (2006.01)
*C22C 1/08* (2006.01)

(52) U.S. Cl.
CPC ..... *B22D 25/005* (2013.01); *B22D 25/02* (2013.01); *C22C 1/08* (2013.01); *C22C 2001/082* (2013.01); *Y10T 428/12479* (2015.01)

(58) Field of Classification Search
CPC ..... B22D 25/005; B22D 25/02; C22C 1/08; C22C 2001/082; Y10T 428/12479
USPC ..... 164/79, 91; 428/613
See application file for complete search history.

(56) References Cited

U.S. PATENT DOCUMENTS 8,151,860 B2 * 4/2012 Mortensen et al. ..... B22C 9/105 164/15
2005/0017394 A1 * 1/2005 Hochsmann et al. ..... B29C 67/0081 264/113

OTHER PUBLICATIONS

Bafti, H.; Habibolahzadeh, A.; "Production of aluminum foam by spherical carbamide space holder technique-processing parameters"; Materials and Design, 2010, vol. 31, p. 4122-4129.*
Goodall Russell et al: "The effect of preform processing on replicated aluminum foam structure and mechanical properties", Scripta Materialia, Elsevier, Amsterdam, NL, vol. 54, No. 12, Jun. 1, 2006, pp. 2069-2073.
Goodall Russell et al: "Spherical pore replicated microcellular aluminum: Processing and influence on properties" Materials Science and Engineering A: Structural Materials Properties Microstructure & Processing, Lausanne, CH, vol. A465. No. 1-2. Jan. 1, 2007, pp. 124-135.

* cited by examiner

*Primary Examiner* — Kevin P Kerns
(74) *Attorney, Agent, or Firm* — Oliff PLC

(57) ABSTRACT

A preform intended for the manufacture of a metal foam having a porosity of between 62% and 85%, the preform including a set of precursors in the form of balls formed of a mixture of 12% to 25% of organic binder, 72% to 87% of sodium chloride and 1 to 3% of kalinite. The precursors have a diameter of around 1 mm to 10 mm, and preferably 4 mm, the precursors being obtained by granulating the mixture using a fluidized bed process.

15 Claims, No Drawings

PREFORM FOR MANUFACTURING A METAL FOAM

BACKGROUND OF THE INVENTION

1. Field of the Invention

The technical scope of the present invention is that of the manufacture of metal foams using preforms made with precursors.

2. Description of the Related Art

Metal foam technology is well known and reference may be made to patents EP-1808 241, U.S. Pat. No. 3,236,706 and EP-2118328 which promote manufacturing a preform in the form of granules made from a salt, such as sodium chloride. After the free space between the granules has been filled in with a molten metal, the salt is dissolved to recover the metal foam.

Thus, patent EP-2118328 describes a particularly interesting method that proposes to manufacture a preform with granules made from grain flour. The preform is then baked before the metal is poured in so as to destroy the granule's carbon chains. According to this patent, a paste is first made using flour, sodium chloride and water. This paste is then made into granules, which are then used to manufacture the preform. It was observed that, in addition to the preparation of the paste, this process led to a mechanical fragility of the preform and to a substantial time required for the preform to dissolve prior to the recovery of the metal foam. Lastly, the metal foam incorporates carbonaceous residues after pyrolysis and saline residues which are difficult to remove. Finally, and more seriously, the surface of the metal foam is flawed because of the corrosion and oxidation resulting from the use of sodium chloride which makes its use in industry problematic.

SUMMARY OF THE INVENTION

The aim of the present invention is to provide means to obtain a metal foam with a surface that is free from residues, and suffers no corrosion, by using a specific preform and implementing a specific process.

The invention thus relates to a preform intended for the manufacture of a metal foam having a porosity of between 62% and 85%, wherein it comprises a set of precursors in the form of balls formed of a mixture of 12% to 25% of organic binder, 72% to 87% of sodium chloride and 1 to 3% of kalinite.

According to one characteristic of the invention, the precursors have a diameter of around 1 to 10 mm and preferably of 4 mm.

According to another characteristic of the invention, the precursors are obtained by granulating the mixture using the fluidized bed process.

According to yet another characteristic of the invention, the organic binder is constituted by grain flour.

According to yet another characteristic of the invention, the precursors comprise 17% of grain flour, 81% of sodium chloride and 2% of kalinite.

According to yet another characteristic of the invention, the precursors comprise 13% of grain flour, 84% of sodium chloride and 3% of kalinite, or else 24% of grain flour, 74.5% of sodium chloride and 1.5% of kalinite.

The invention also relates to a process for manufacturing a metal foam using a preform, wherein it comprises the following steps:

the precursor is introduced into a mould which is then vibrated to define the free spaces, the mould is heated to a temperature of between 300 and 600° C. to activate the kalinite, while injecting an air flow into the mould during the rise in temperature, the temperature is maintained for 10 to 40 minutes, the molten metal is poured in to fill the free spaces between the precursors, and it is allowed to cool and the metal foam is washed.

Advantageously, the process comprises a step of humidifying and drying the precursors before the heating step.

Humidification is performed using 3 to 10% of water relative to the mass of the precursors.

The molten metal is a pure metal, in particular aluminium, or a metal alloy.

Advantageously, foundry cores are arranged in the preform to produce specific paths.

The invention further relates to the open-cell metal foam obtained by using the process according to the invention.

Advantageously, the foam has no corrosion after being washed and/or the foam has no oxidation after being washed and/or in that it is free from carbonaceous residues after washing and/or in that it is free from saline residues after washing.

Advantageously, the foam has an open porosity of between 65 and 85%.

The metal foam is made of aluminium or aluminium-based alloy.

A first advantage of the present invention lies in the ease of shaping the preform and in its mechanical strength, in that the preform does not disintegrate.

Another advantage of the invention lies in the speed, which is almost instantaneous, at which the preform can be removed.

Yet another advantage of the invention lies in the absence of any corrosion or oxidation of the metal foam.

Yet another advantage lies in the ability to control the porosity, which can be adjusted according to the size of the precursors and the possible connections between them (for example, agglomeration through humidification).

Other characteristics, advantages and particulars of the invention will become more apparent from the additional description hereafter of the embodiments given by way of example.

DETAILED DESCRIPTION OF PREFERRED EMBODIMENTS

In the following description, the term "precursors" shall mean balls formed by a mixture with sodium chloride. The organic binder may be a carbohydrate, for example grain flour.

In the following description, focus will be on flour in particular, without this being a limitation to the invention provided that the compound used instead acts as an organic binder.

Thus, the flour may be that which is commonly obtained using cereal grains such as wheat, barley, sorghum or rye. Naturally, other vegetal flours may also be used. This flour is naturally sieved so as to obtain a substantially constant particle size. Flour with a particle size of around 200 μm, and advantageously less than 150 μm, may be used.

The sodium chloride used may have a grain size that is smaller than or equal to 200 μm. The particle size of the flour and sodium chloride will preferably be chosen similar to one another.

To produce the precursors to form the preform, the following or equivalent process is used. The initial mixture is composed of 12 to 25% of organic binder, for example grain flour, 72 to 87% of sodium chloride and 1 to 3% of kalinite. These are naturally percentages in mass. The mixture is produced by pouring and stirring the organic binder into the salt and then adding the kalinite. This operation lasts for several minutes.

The intimate blend obtained is then spread and subjected to granulating by fluidized bed process. This method produces and even and controllable particle size for the precursors of around 1 to 10 mm. Advantageously, the diameter of the precursors is of around 4 mm. The precursors obtained are dry and rigid and are ellipsoidal or spherical in shape.

The choice of kalinite is important to the invention in that it is the kalinite which enables a metal foam to be obtained having the previously mentioned advantages. Kalinite is known as a mineral sulphate or potassium alun formula $KAl(SO_4)_2.11H_2O$ whose melting point is of 92-93° C. Kalinite has been advantageously observed to become anhydrous at temperatures of around 200° C. This serves to evacuate all the residual molecules of water in the precursors during the rise in temperature in the mould thereby releasing the intermolecular spaces in the precursors.

Advantageously, the preform can be formed of precursors comprising 17% of grain flour, 81% of sodium chloride and 2% of kalinite.

Advantageously, the preform can be formed of precursors comprising 13% of grain flour, 84% of sodium chloride and 3% of kalinite.

Advantageously again, the preform can be formed of precursors comprising 24% of grain flour, 74.5% of sodium chloride and 1.5% of kalinite.

The preform is implemented in the following or equivalent manner.

The precursors are introduced into a mould without being agglomerated together and the preform thus obtained is in the shape of the mould used. Naturally, the inner shape of the mould depends on the final shape of the metal foam that is required. It is possible for the precursors to be densified by mechanically vibrating the mould so as to reduce the free space between the precursors.

In this case, the mould enclosing the preform is placed in a furnace and an air current or air flow is made to flow through the mould. The mould is then gradually heated to a temperature of between 300 and 600° C. and maintained at this temperature for 10 to 40 minutes. Throughout all the heating time, an air current or air flow is made to pass through the preform. This air flow in the mould promotes the rapid activation of the kalinite and participates in the pyrolysis of the precursors.

The molten metal is introduced to fill the free spaces, allowed to cool and then the metal foam is washed.

By way of a variant, the kalinite can be activated before the precursors are introduced into the mould. In this case, the precursors are heated under a suitable atmosphere for 15 minutes, then they are introduced into the mould, densified and the molten metal is then poured in.

The conditions of use of molten metals are well known in foundry operations and do not require further description here.

During the rise in temperature, the pyrolysis of the preform is performed allowing the activation of the kalinite and consequently a better dissolution of the preform after formation of the porous media of the metal foam. This dissolution is very rapid and appears in an effervescent form with the precursors therefore being removed without difficulty.

After washing, the surface of the metal foam has no saline or carbonaceous residue nor does it show any corrosion and/or oxidation. There is, therefore, no reaction between the metal and the sodium chloride in contrast to metal foams obtained using processes according to prior art.

The same results are obtained regardless of the composition of the preform indicated above.

The process according to the invention is particularly advantageously for the manufacture of aluminium foams or aluminium alloy foams. Alloys references AZ7, AS7G3, AS7G06, AS10 or AS9 are commonly used for this purpose. Naturally, other metals can be used in the process according to the invention to manufacture metal foams, for example zinc or magnesium.

Foundry cores can be arranged in the preform to manufacture specific paths. This is the case, for example, when a specific circuit is to be established between two faces of metal foam.

Generally speaking, the process according to the invention can be implemented using any metal or metal alloy whose melting point is less than 750° C.

Advantageously, the molten metal can be introduced under pressure by being injected into the mould or by natural gravity.

Advantageously, before the preform is introduced into the mould, a humidifying and drying step for the precursors can be made. Humidification enables the precursors to be agglomerated together thereby increasing the relative density of the preform, and controlling the morphological characteristics of the metal foam in particular with respect to the neck and strand diameter.

The neck corresponds to the opening between the foam pores that corresponds to the cavity left by the spheres of precursor after removal and the strand is formed by the skeleton of the metal foam, which is to say the space between the precursor spheres.

This humidification is made with 3% to 10% of water with respect to the mass of the precursors. It goes without saying that drying can be performed during the pyrolysis because of the air current or air flow circulating through the preform.

The invention also relates to open cell metal foams obtained using the process according to the invention and whose relative density or porosity is of between 65 and 85% with cell diameters of around 4 mm. It goes without saying that the porosity corresponds to the percentage of free space with respect to the total volume of the metal foam.

What is claimed is:

1. A process for manufacturing a metal foam using a preform having a porosity of between 62% and 85%, the preform including a set of precursors in the form of balls formed of a mixture of 12% to 25% of organic binder, 72% to 87% of sodium chloride and 1 to 3% of kalinite, the process comprising the following steps:

providing the precursors into a mould;

vibrating the mould to define free spaces;

heating the mould to a temperature between 300° C. and 600° C. to activate the kalinite, and injecting an air flow into the mould during the rise in temperature;

maintaining the temperature of the heated mould for 10 minutes to 40 minutes;

pouring a molten metal in the mould to fill the free spaces between the precursors; and cooling the molten metal to form the metal foam; and washing the metal foam.

2. The process to manufacture the metal foam according to claim 1, wherein the process comprises a step of humidifying and drying the precursors before the heating step.

3. The process to manufacture the metal foam according to claim 2, wherein the humidification is performed using 3% to 10% of water relative to a mass of the precursors.

4. The process to manufacture the metal foam according to claim 1, wherein the molten metal is a pure metal or a metal alloy.

5. The process to manufacture the metal foam according to claim 4, wherein the pure metal or metal alloy includes aluminum.

6. The process to manufacture the metal foam according to claim 1, wherein foundry cores are provided in the preform to produce at least one specific path in the metal foam.

7. The process to manufacture the metal foam according to claim 6, wherein the at least one specific path forms a circuit between at least two faces of the metal foam.

8. The process to manufacture the metal foam according to claim 1, wherein the precursors have a diameter of around 1 mm to 4 mm.

9. The process to manufacture the metal foam according to claim 1, wherein the precursors are obtained by granulating the mixture using a fluidized bed process.

10. The process to manufacture the metal foam according to claim 1, wherein the organic binder includes grain flour.

11. The process to manufacture the metal foam according to claim 10, wherein the precursors comprise:

17% of grain flour, 81% of sodium chloride and 2% of kalinite, or

13% of grain flour, 84% of sodium chloride and 3% of kalinite, or

24% of grain flour, 74.5% of sodium chloride and 1.5% of kalinite.

12. The process to manufacture the metal foam according to claim 11, wherein the precursors have a diameter of around 1 to 4 mm.

13. The process to manufacture the metal foam according to claim 12, wherein the precursors are obtained by granulating the mixture using a fluidized bed process.

14. The process to manufacture the metal foam according to claim 11, wherein the precursors are obtained by granulating the mixture using a fluidized bed process.

15. The process to manufacture the metal foam according to claim 14, wherein the molten metal is a pure aluminum.

* * * * *